US005482063A

United States Patent [19]

Miura et al.

[11] Patent Number: 5,482,063

[45] Date of Patent: Jan. 9, 1996

[54] TANK CLEANING DEVICE

[75] Inventors: Takao Miura; Isao Miura, both of Kawaguchi, Japan

[73] Assignee: Kabushiki Kaisha Kit, Saitama, Japan

[21] Appl. No.: 272,499

[22] Filed: Apr. 7, 1994

[30] Foreign Application Priority Data

May 13, 1993 [JP] Japan ..... 5-111919

[51] Int. Cl.[6] ..... B08B 9/06

[52] U.S. Cl. ..... 134/56 R; 134/167 R; 134/181; 91/2

[58] Field of Search ..... 134/56 R, 167 R, 134/181, 57 R, 58 R; 92/5 R, 129; 91/2

[56] References Cited

U.S. PATENT DOCUMENTS

| | | | |
|---|---|---|---|
| 1,392,115 | 9/1921 | Cheney | 91/2 |
| 1,605,840 | 11/1926 | Hubers et al. | 91/2 X |
| 2,200,663 | 5/1940 | Wilson | 91/2 X |
| 4,798,334 | 1/1989 | Harrington | 239/227 |
| 5,172,710 | 12/1992 | Harrington | 134/181 X |

FOREIGN PATENT DOCUMENTS

| | | |
|---|---|---|
| 56-20907 | 5/1981 | Japan . |
| 59-203679 | 11/1984 | Japan . |
| 62-60146 | 12/1987 | Japan . |
| 459034 | 9/1992 | Japan . |

*Primary Examiner*—Frankie L. Stinson
*Attorney, Agent, or Firm*—Jordan and Hamburg

[57] ABSTRACT

A cylinder containing a piston rod to which a nozzle is attached, is fixed to the outside of a tank. A pressurized fluid is sprayed into the tank from the nozzle, and the piston rod elongates and contracts with the pressure of this fluid. Further provided are a first supply passage connecting a first pressure chamber formed around the piston rod in the cylinder to a pump, a return passage connecting a second pressure chamber on the opposite side of the piston rod to the tank, and a second supply passage connecting the second pressure chamber to the pump. A first valve is provided in the return passage, and a second valve is provided in the second supply passage. In addition, there are provided a mechanism for detecting the contracted and an elongated position of the piston rod, a mechanism for closing the first valve and opening the second valve when the contracted position is detected, and a mechanism for opening the first valve and closing the second valve when the elongated position is detected, and the piston rod is made to automatically execute contraction/elongation cycles. Still further provided is a mechanism for stopping the operation of the pump when the number of these cycles has reached a predetermined value. In this manner, fluid is sprayed in the tank to clean its interior while the nozzle automatically moves back and forth in the tank, and the spray automatically stops when a preset number of back and forth movements have been executed.

7 Claims, 7 Drawing Sheets

TANK CLEANING DEVICE

FIELD OF THE INVENTION

This invention relates to a control of a tank cleaning device wherein a nozzle sprays pressurized fluid inside a tank by means of fluid pressure.

BACKGROUND OF THE INVENTION

In devices that clean the interior of tanks in chemical plants, food tanks and fermentation tanks, a nozzle is for example disposed inside the tank, and made to rotate so as to spray cleaning fluid inside the tank.

A device wherein a pair of nozzles are made to rotate about a horizontal axis, and the holder supporting the nozzles is made to rotate about a vertical axis so as to spray cleaning fluid uniformly in up, down, left and right directions, is disclosed in Tokko Sho 62-60146 published by the Japanese Patent Office.

However, if the tank is longer in the upward/downward direction as in the case of a cylindrical tank, for example, the tank cannot be cleaned uniformly if the nozzle is fixed even if the spray is made uniform in all directions. In such a tank, uniform cleaning can be performed if the nozzle holder is moved up and down while spraying takes place, but this requires the use of a raising and lowering mechanism comprising a motor and gears for example, that make the device complicated and costly.

In order to solve this problem, cleaning devices wherein the nozzle holder is moved up and down by the pressure of the cleaning fluid are disclosed in Tokkal Sho 59-203679, Tokko Sho 56-20907 and Tokko Hei 4-59034 published by the Japanese These devices employ a cylinder housing a piston that elongates and contracts a piston rod fixed to the piston due to the pressure of the cleaning fluid, the nozzle holder being supported at the end of this rod. The cylinder comprises pressure chambers separated by the piston that drive the piston to elongate or contract the piston rod. When pressurized fluid is selectively supplied to one or the other of these chambers, therefore, the nozzle holder rises or falls. The cylinder is attached on the top of the tank, and as the nozzle holder rises or fails in the tank due to the elongation or contraction of the piston rod, cleaning fluid is sprayed from the nozzle. This cleaning fluid is supplied through the hollow part of the piston rod. When it is not in use the nozzle holder is raised to its storage position at the top of the tank due to the contraction of the piston rod.

According to these devices, cleaning of long tanks, such as for example cylindrical tanks, may be uniformly performed without using electrical energy.

In these devices, however, if the piston rod elongates and contracts at a constant speed, the cleaning fluid that is sprayed due to the rotation of the nozzles and nozzle holder leaves marks at regular intervals on the inner surface of the tank. If the speed of the piston rod is slowed down, the interval between these marks becomes smaller and the cleaning efficiency improves, but more time is then required until the whole cleaning process is accomplished. In order to obtain high cleaning efficiency in a short time, it is therefore desirable for example to make the ascending speed of the piston rod different from its descending speed so that cleaning marks do not overlap each other.

Further, in order for the cleaning device to clean the tank automatically according to a preset program, the changeover of the piston rod from elongation to contraction and vice versa, the ascending/descending speeds of the nozzle holder stud the number of ascents and descents of the nozzle holder must be centrally controlled. However, these devices were not provided with a control mechanism to optimize cleaning efficiency and automate the cleaning operation.

SUMMARY OF THE INVENTION

It is therefore an object of this invention to provide a cleaning device that automates the tank cleaning operation comprising a nozzle holder supported in a cylinder, this holder rotating about the center axis of the cylinder, and a nozzle supported by the nozzle holder, this nozzle rotating parallel to the center axis of the cylinder.

It is a further object of this invention to optimize the cleaning efficiency of such a cleaning device.

In order to achieve the above objects, this invention provides a tank cleaning device comprising a cylinder fixed to an outside of a tank, a piston housed inside the cylinder such that it is free to slide axially in the cylinder, and a piston rod fixed to the piston. The piston rod has an end projecting inside the tank and a nozzle is attached to this end. The piston rod elongates and contracts outside the cylinder between a limiting elongated position and a limiting contracted position according to the slide of the piston. In the cylinder a first pressure chamber is formed by the piston around the piston rod inside the cylinder and a second pressure chamber is also formed by the piston on the opposite side of the piston rod. A pressurized fluid is provided by a pump to the first pressure chamber via a first supply passage and then guided to the nozzle via a passage formed inside the piston rod. The second pressure chamber is connected to a drain via a return passage and a first valve. The second pressure chamber is also connected to the pump via a second supply passage and a second valve. The device further comprises a mechanism for detecting a contracted position of the piston rod, a mechanism for detecting an elongated position of the piston rod, a mechanism for closing the first valve and opening the second valve when the contracted position is detected, a mechanism for opening the first valve and closing the second valve when the elongated position is detected, a mechanism for counting the number of contraction and elongation cycles executed by the piston rod between the contracted position and the elongated position, and a mechanism for stopping operation of the pump when it is detected that the number of contraction and elongation cycles has reached a predetermined value. Preferably, the counting mechanism comprises a mechanism for counting the number of times the piston reaches the contracted position.

Also preferably, the contracted position is less contracted than the limiting contracted position and the elongated position is set equal to the limiting elongated position. Also preferably, the device further comprises a pressure regulating valve for regulating a pressure provided by the pump to a set pressure, a mechanism for detecting a direction of the slide of the piston, and a mechanism for modifying the set pressure according to the direction. Alternatively, the set pressure is modified according to the number of contraction and elongation cycles.

According to another aspect of the invention, the device comprises a mechanism for detecting a contracted position of the piston rod and a mechanism for detecting an elongated position of the piston rod. The contracted position is less contracted than the limiting contracted position of the piston rod and the elongated position is equal to the limiting elongated position of the piston rod. The device also comprises a mechanism for closing the first valve and opening the second valve when the contracted position is detected, a mechanism for opening the first valve and closing the second valve when the elongated position is detected, a mechanism for counting the number of contraction and elongation cycles executed by the piston rod between the contracted position and the elongated position, a mechanism for returning the piston rod to the limiting contracted position when the number of contraction and elongation cycles reaches a predetermined value, a mechanism for detecting that the piston rod has reached the limiting contracted position, and a mechanism for stopping operation of the pump mechanism when it is detected that the piston rod has reached the limiting contracted position. Preferably, the device further comprises a housing formed on the outside of the tank with an opening thereto for accommodating the nozzle in the limiting contracted position, a partition valve for sealing off the housing from the tank, and a mechanism for closing the partition valve when the piston rod has reached the limiting contracted position. The details as well as other features and advantages of this invention are set forth in the remainder of the specification and are shown in the accompanying drawings.

DESCRIPTION OF THE PREFERRED EMBODIMENTS

Figure 1:
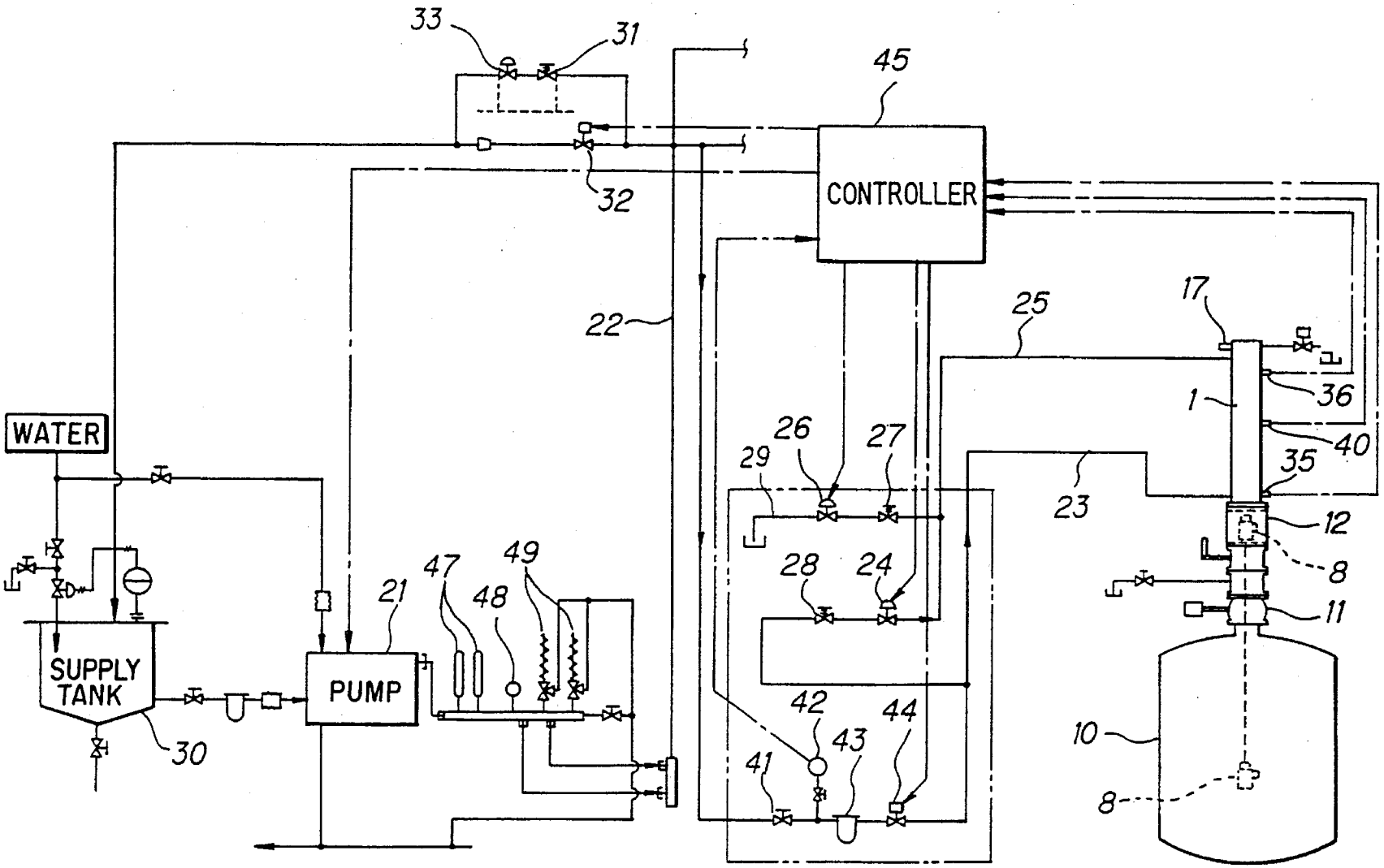
FIG. 1 is a schematic diagram of a cleaning device according to this invention.
Figure 3:
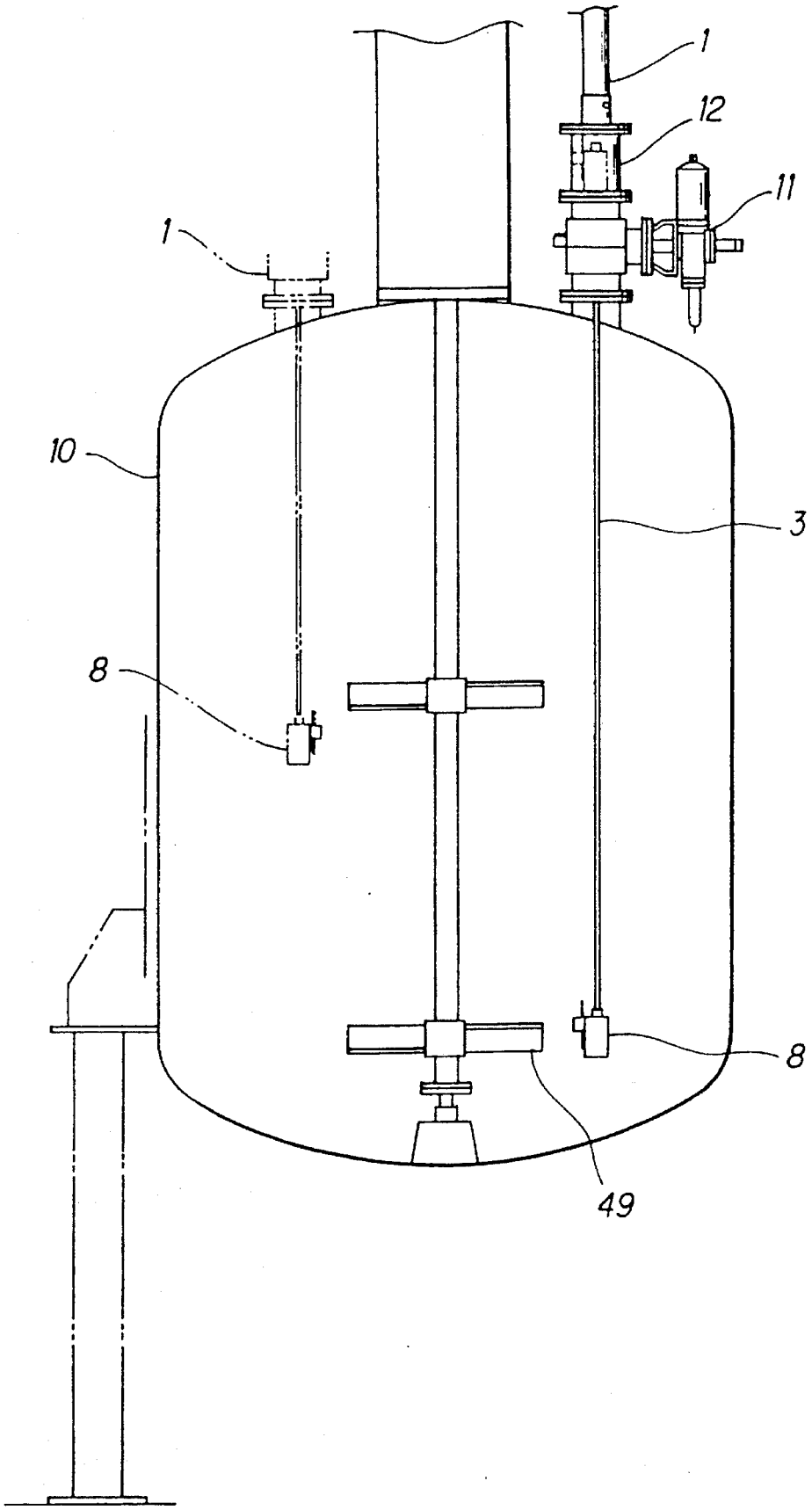
FIG. 3 is a vertical sectional view of a tank to which the cleaning device according to this invention is applied.

Referring to FIG. 1 of the drawings, a housing 12 is attached on the top of a tank 10 via a partition valve 11, a nozzle device 8 that sprays pressurized fluid in three dimensions being housed inside the housing 12. In this figure, the cleaning device is disposed in the center of the tank 10, however in reality a stirring rod 49 is provided in the center of the tank 10 as shown in FIG. 3 and three units of the cleaning device are disposed around the rod 49.

Figure 4:
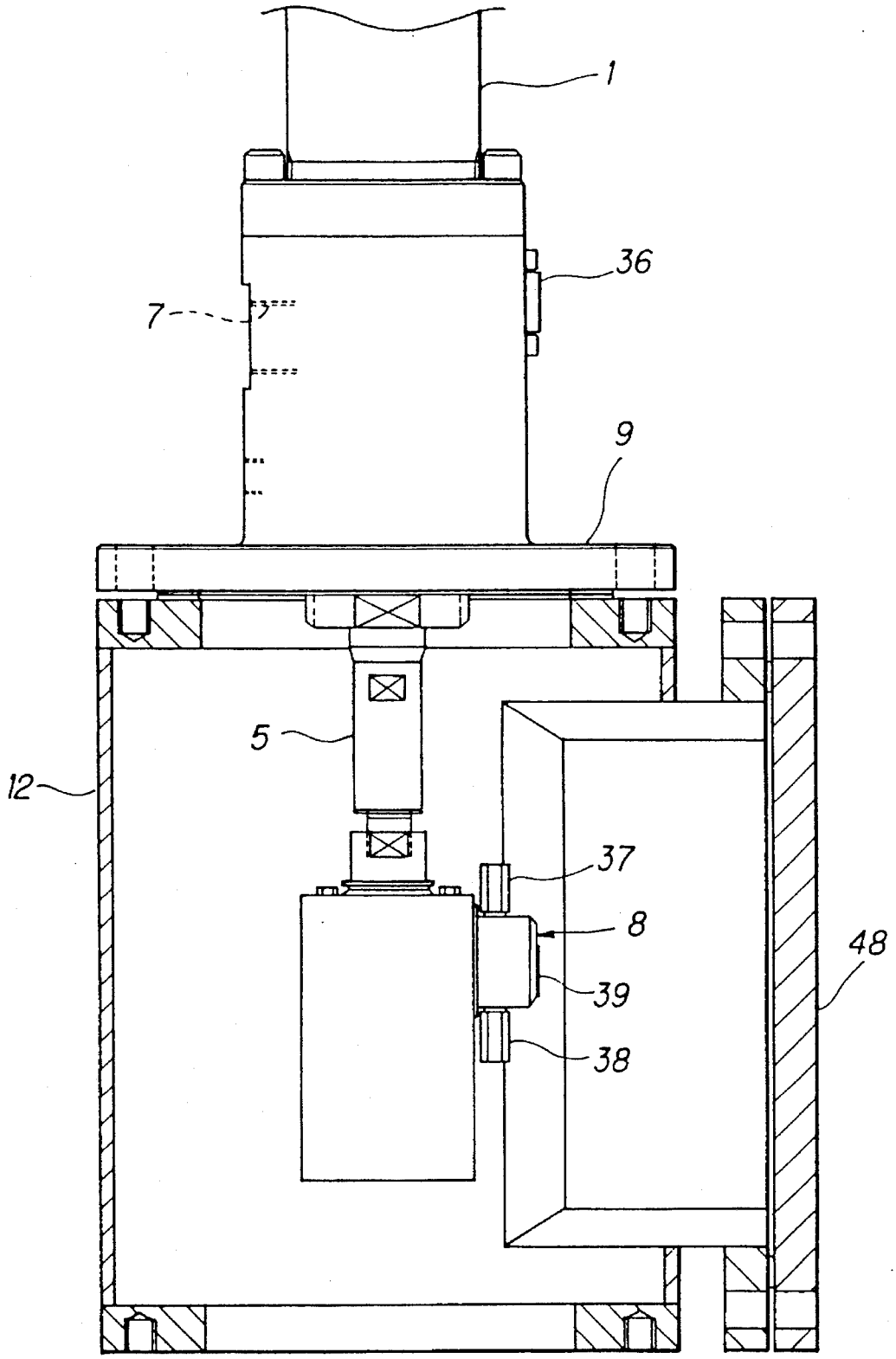
FIG. 4 is a vertical sectional view of a nozzle holder stored in the cleaning device according to this invention.

As shown in FIG. 4, the nozzle device 8 comprises a nozzle holder 39 supporting a pair of nozzles 37, 38. The nozzle holder 39 is rotated around a vertical axis by the pressure of the cleaning fluid supplied to the inside of the nozzle holder 39, the fluid is sprayed from the nozzles 37, 38, and the nozzles 37, 38 are rotated around a horizontal axis due to the reaction of the spray. Such a nozzle device is disclosed in, for example, Tokkai Sho 62-60146 published by the Japanese Patent Office.

A cylinder 1 is vertically attached to the upper part of the housing 12 via a flange 9, the nozzle holder 39 being attached to the lower end 5 of a piston rod 3 which projects inside the housing 12 from the cylinder 1.

The partition valve 11 is a ball valve driven by an air actuator, the passage between the housing 12 and tank 10 being obstructed or connected according to an electrical signal supplied from outside. A sluice valve can also be applied as the partition valve 11.

The housing 12 is closed by a cover 48 as shown in FIG. 4. The nozzle device 8 or packing thereof may be replaced by removing this cover 48.

Figure 2:
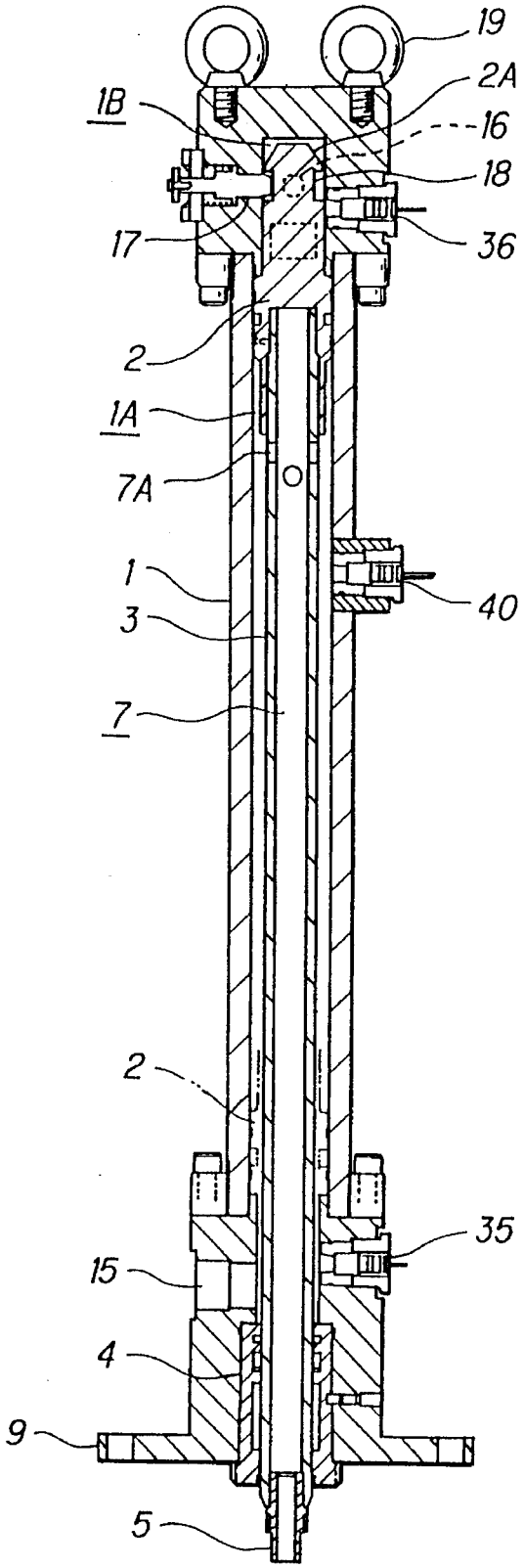
FIG. 2 is a vertical sectional view of a cylinder in the cleaning device according to this invention.

The internal structure of the cylinder 1 is shown in FIG. 2. A piston 2 is fixed to the upper end of the piston rod 3 inside the cylinder 1, the cylinder 1 being divided into pressure chambers 1A and 1B by the piston 2. The piston rod 3 is supported free to slide in the cylinder 1 via a bearing 4.

The cylinder 1 is provided with a port 15 that connects the pressure chamber 1A, and a port 16 that connects the pressure chamber 1B. A throughhole 7A and passage 7 are formed in the piston rod 3 so as to conduct pressurized fluid in the pressure chamber 1A to the nozzle device 8.

A lock pin 17 is provided in the upper part of the cylinder 1 to hold the piston 2 at an ascent limit position corresponding to the storage position of the nozzle device 8. The lock pin 17 locks the piston 2 when it engages with a hollow 18 formed in the piston 2.

The pressure supplied to the pressure chamber 1B causes the lock pin to withdraw against the force of a spring. This releases the lock, and when the pressure in the pressure chamber 1B fails, the pin again projects into the pressure chamber 1B. If the piston 2 ascends to its ascent limit position due to the high pressure of the pressure chamber 1 A, a taper part 2A pushes the lock pin 17 away so that the piston 2 reaches this position. After the taper part 2A has passed, the lock pin 17 that had withdrawn then engages with the hollow 18 so as to lock the piston 2 again.

A magnet is attached to the piston 2, magnetic sensors 35, 36, 40, as a means of detecting the positions of the piston 2, being provided to detect the approach of this magnet to a predetermined position on the cylinder 1. The sensor 35 is attached to the cylinder 1 at the descent limit position of the piston 2, and the sensor 36 is attached to the cylinder 1 at the ascent limit position of the piston 2. The sensor 40 is attached to the cylinder 1 at the position of the piston 2 when the nozzle 8 is in the uppermost part of the tank 10. The ascent limit position of the piston 2 corresponds to the limiting contracted position of the piston rod 3 and the descent limit position of the piston 2 corresponds to the limiting contracted position of the piston rod 3.

These positions may also be detected by measuring the flowrate of the fluid entering to or discharging from the pressure chamber 1A or 1B.

The cleaning fluid is supplied by means of the circuit shown in FIG. 1.

Cleaning fluid stored in a supply tank 30 is taken in by a pressurizing pump 21, and is supplied to a feed pipe 22 under a constant pressure via a manometer 48 and pressure regulating valve 49. It is then distributed by this feed pipe 22 to three cylinders 1 respectively via a manual valve 41, manometer 42, filter 43 and cleaning valve 44. Only the part of the circuit from the feed pipe 22 to one of the cylinders 1 is shown in FIG. 1, the other two cylinders 1 being connected to the feed pipe via similar circuitry.

A passage 23 that branches off the feed pipe 22, leads to the pressure chamber 1A via the cleaning valve 44.

A passage 25 branches off the passage 23 downstream from the cleaning valve 44, and leads to the pressure chamber 1B of the cylinder 1 via a variable throttle 28 and descending valve 24. The passage 25 is also connected to a drain via a return passage 29. A variable throttle 27 and ascending valve 26 are disposed in the return passage 29. With the cleaning valve 44 open, when the descending valve 24 is opened, the ascending valve 26 is closed and the pump discharge pressure is supplied to both the pressure chambers 1A and 1B, the piston 2 moves down according to the difference of pressure receiving surface area of the piston, and the nozzle device 8 supported by the piston rod 3, also moves down. The speed of this downward motion is controlled by the opening of the variable throttle 28, that is by the flowrate of the pressurized fluid supplied to the pressure chamber 1B. When the descending valve 24 is closed and the ascending valve 26 is opened, the pump discharge pressure is supplied only to the pressure chamber 1A, the piston 2 moves up, and the nozzle device 8 supported by the piston rod 3 is also moved up. As the cleaning fluid from the pressure chamber 1B flows to the drain via the return passage 29, the ascending speed of the nozzle device 8 is controlled by the opening of the variable throttle 27 while fluid is draining off.

The pressure of the feed pipe 22 is fine-adjusted by a pressure control valve 32 that responds to an input signal from the outside, thereby varying the ascending and descending speed of the piston 2. The feed pipe 22 is connected to the supply tank 30 via a throttle 31 and cylinder valve 33, and excess pressurized fluid discharged by the pump 21 flows back to the supply tank 30.

All control of the cleaning fluid supply circuit is performed by a controller 45. Magnetic detection signals from the magnetic sensors 35, 36, 40, and a pressure signal detected by the manometer 42, are input to the controller 45. Based on these signals and on a preset cleaning pattern, the controller 45 performs various controls by outputting control signals to operate the pump 2 1, to open or close the cleaning valve 44, descending valve 24, ascending valve 26 and pressure control valve 32, or to control the degree of opening of these valves.

Figure 5:
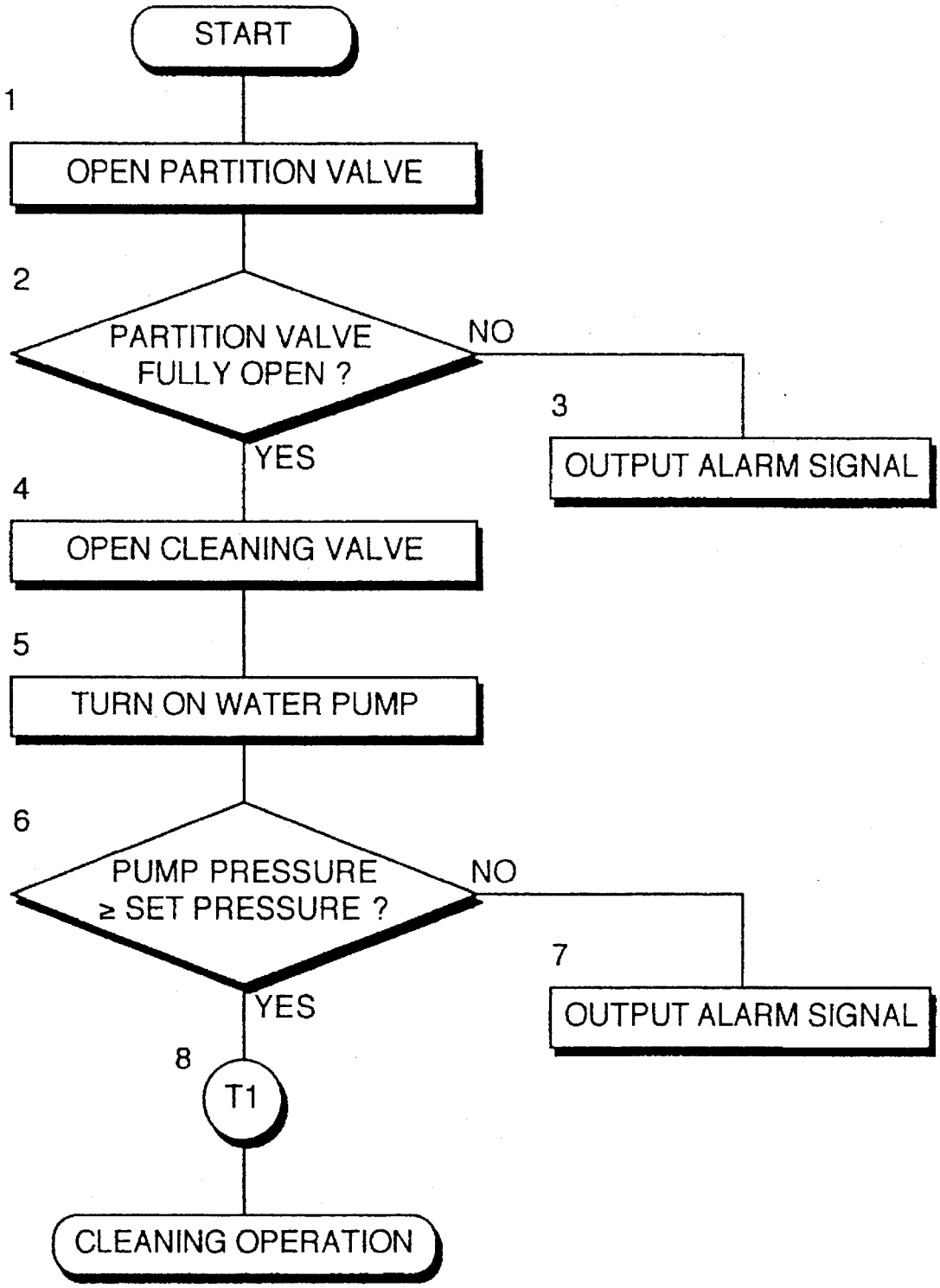
FIG. 5 is a flowchart showing a control process of a pre-cleaning operation of the cleaning device according to this invention.
Figure 6:
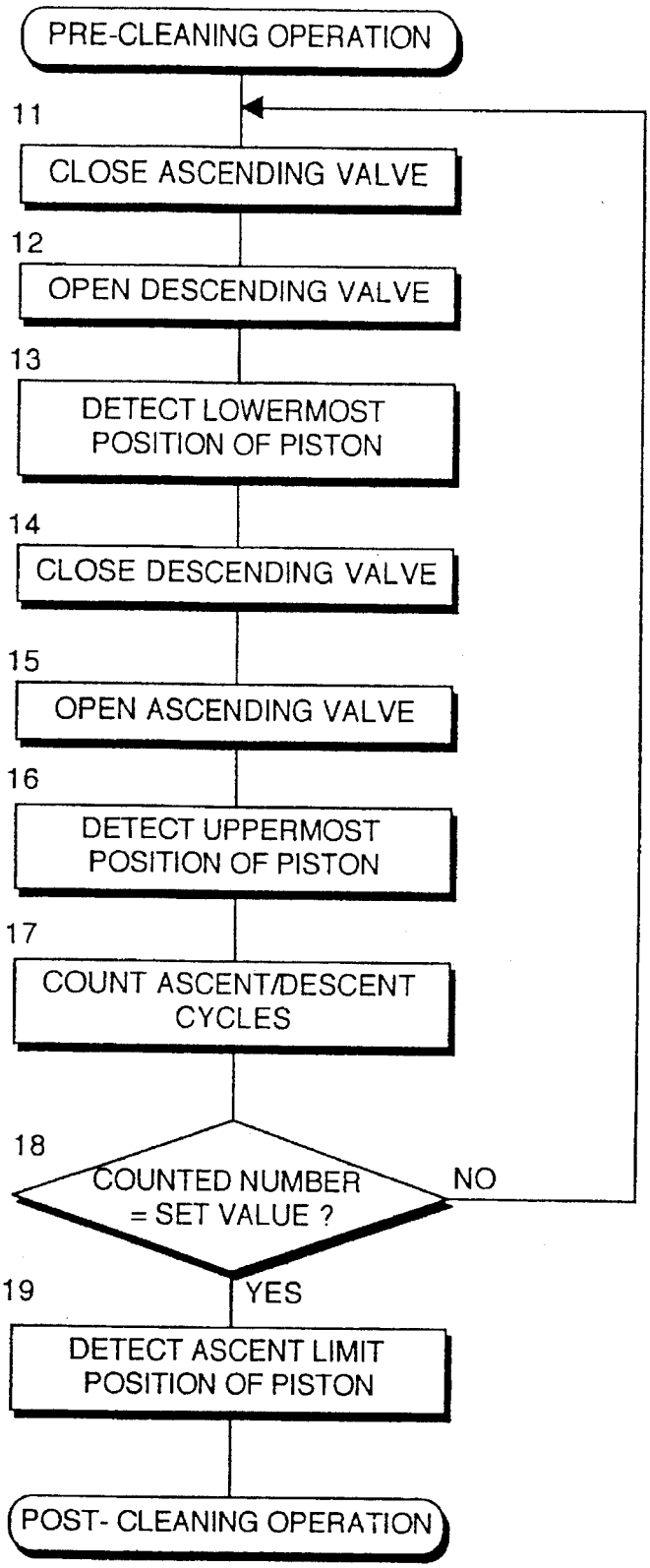
FIG. 6 is a flowchart showing a control process of a cleaning operation of the cleaning device according to this invention.
Figure 7:
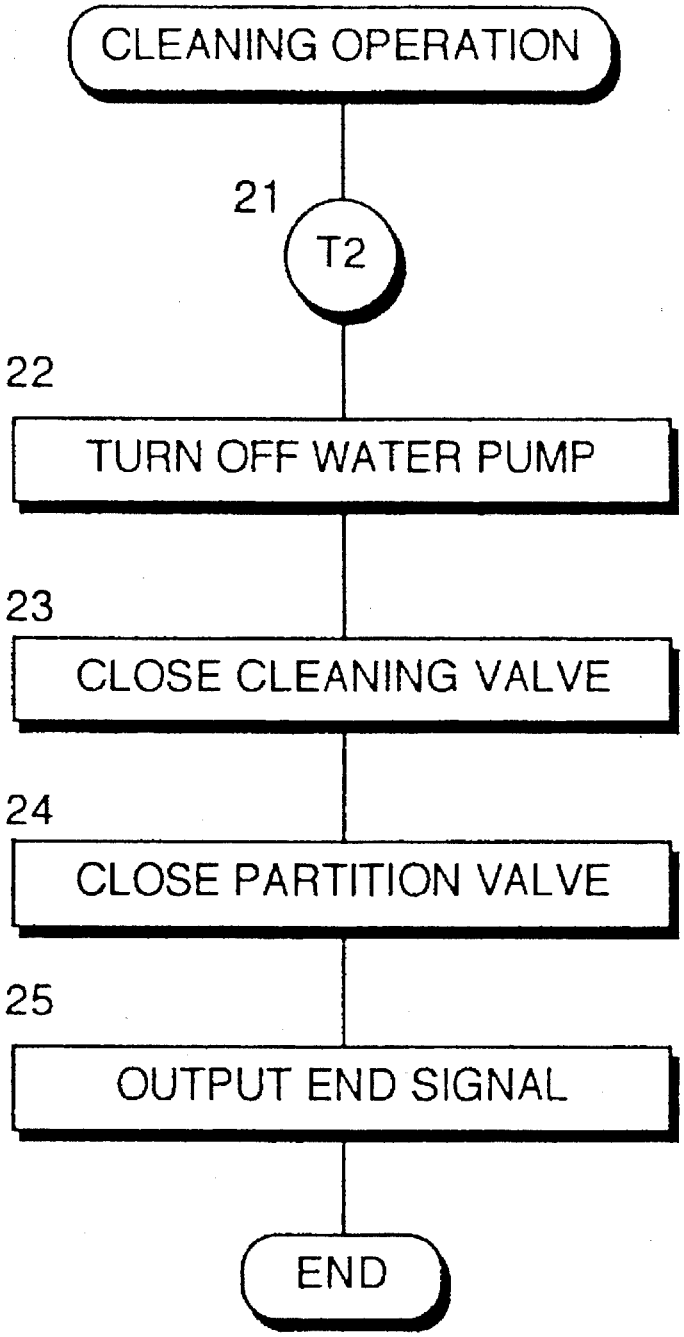
FIG. 7 is a flowchart showing a control process of a post-cleaning operation of the cleaning device according to this Invention.

This control process is described using the flowcharts of FIGS. 5–7. The process is executed at fixed time intervals. The controller 45 starts control when a cleaning start signal is input by an operator.

As shown in FIG. 5, when a cleaning start signal is input, the controller 45 commands the partition valve 11 to fully open (step 1). It is confirmed whether or not the partition valve 11 is fully open (step 2), and the cleaning valve 44 is opened (step 4). Next, the pump 21 is operated (step 6), and when the pressure of the feed pipe 22 detected by the manometer 42 reaches a set value (step 7), the routine advances to the cleaning operation shown in the flowchart of FIG. 6 after a time $T_1$ required for the metal contact between the lock pin 17 and the piston 2 to be released (step 8). In the step 8, pressure is applied to the pressure chamber 1A so as to slightly raise the piston 2, thereby releasing the mechanical contact between the lock pin 17 and piston 2, and when a high pressure is supplied to the pressure chamber 1B, the lock pin 17 smoothly withdraws.

If the partition valve 11 is not fully open in the step 2, and the pressure of the feed pipe 22 does not reach the predetermined value in the step 7, alarm signals are correspondingly output (steps 3, 7). In this case, the controller 45 terminates control without executing the following process.

In the flowchart shown in FIG. 6, the controller 45 first shuts the ascending valve 26 and opens the descending valve 24 so as to lower the piston (steps 11, 12).

In the cylinder 1, the pressure of the pressure chambers 1 A, 1B become the same, and the piston 2 starts to descend according to the difference of pressure-receiving surface area. Before this descent occurs, the lock pin 17 withdraws due to the rise of pressure in the pressure chamber 1 B, and the lock of the piston 2 is released.

The speed at which the piston 2 descends varies according to the opening of the variable throttle 28. The piston 2 can therefore be made to descend at a set speed by setting the throttle opening according to the desired descent speed.

As the piston 2 descends, the nozzle device 8 descends in the tank 10 while the nozzles 37, 38 and the nozzle holder 39 respectively rotate. Also, pressurized fluid from the pressure chamber 1A that was supplied via the passage 7 is sprayed from the nozzles 37, 38 so as to clean the interior of the tank 10.

When it is detected, by means of a magnetic detection signal from the magnetic sensor 35, that the piston 2 has reached its lowermost position (step 13), the controller 45 shuts the descending valve 24 and opens the ascending valve 26 (steps 14, 15). Pressurized fluid in the feed pipe 22 is then supplied only to the pressure chamber 1A, so the piston 2 rises, and fluid in the pressure chamber 1B is discharged to the drain from the return passage 29 due to the contraction of the pressure chamber lB. This discharge speed is determined by the opening of the variable throttle 27. The piston 2 can therefore be made to rise at a set speed by setting the opening of the throttle 27 according to the desired ascent speed.

Next, when it is detected that the nozzle device 8 has reached the uppermost part of the tank 10 (step 16), the number of ascent/descent cycles of the piston rod 3 is counted (step 17), the routine returns to the step 11 and closes the ascent valve 26, opens the descent valve 24, and lowers the piston 2 again. Following this, the nozzle device 8 sprays cleaning fluid inside the tank 10 as it ascends and descends between the descent limit position detected by the magnetic sensor 35 and the ascent limit position detected by the magnetic sensor 40 until the count number has reached a predetermined value.

The ascent speed and descent speed of the piston 2 are basically respectively determined by the variable throttles 27 and 28. However, even if these throttle openings are invariant, the ascent/descent speed of the piston 2 can be made to vary by slightly varying the pressure in the feed pipe 22 by means of a pressure control valve 32. The controller 45 determines whether or not the piston 2 is ascending or descending, and adjusts the speed of the piston 2 by varying the set pressure of the pressure control valve 32 within a small range. As a result, the positions of the marks made by the cleaning fluid sprayed from the nozzles 37, 38 on the wall of the tank 10 vary. The marks left when the piston is ascending and when it is descending therefore no longer overlap, cleaning is performed uniformly, mid a high cleaning efficiency is obtained.

Instead of varying the set pressure of the pressure control valve 32 when the piston is ascending and descending, the ascent and descent speeds can be varied also by setting the openings of the variable throttles 27 and 28 to different values. Alternatively, instead of making the ascent and descent speeds of the piston 2 different, a uniform, high cleaning efficiency may also be obtained by varying the speed of the piston 2 according to the counted number of ascent/descent cycles.

When the count number reaches the specified value due to repeated ascents and descents of the nozzle device 8 (step 18), the controller 45 continues raising the piston 2 without returning to the step 11. The piston 2 ascends to its ascent limit position as the tapered part 2A pushes the lock pin 17 aside, and the controller 45 detects that the piston 2 has reached its ascent limit position by means of a magnetic detection signal from the magnetic sensor 36 (step 19). The cleaning operation is thereby terminated, and the post-cleaning operation of FIG. 7 is then performed.

In the operation of FIG. 7, after waiting a time $T_2$ for the lock pin 17 to firmly engage with the hollow 18 of the piston 2 so as to lock the position of the piston (step 21 ), the pump 21 is turned off (step 22).

The cleaning valve 44 and the partition valve 11 are then turned off (steps 23, 24), a cleaning end signal is output, and the routine is terminated (step 25).

The nozzle device 8 is housed in the housing 12, and it is sealed off from the tank 10 by the partition valve 11. Even if some dirt adheres to the nozzle device 8, therefore, there is no need for concern that the tank 10 will be soiled in use by the nozzle device 8.

A cleaning operation having a fixed number of ascents and descents may therefore be automatically performed by having the controller 45 count the number of ascents and descents executed by the piston 2, and the cleaning operation may be optimized by slightly varying the speed of the piston 2.

According to the above embodiment, the highest ascent position of the nozzle device 8 in the tank 10 is detected by the magnetic sensor 40. However, the time elapsed from when the descent limit position is detected by the magnetic sensor 35 may for example be measured, and the nozzle device 8 determined to have reached its highest ascent position when the time elapsed is equal to a predetermined value. In this case, the magnetic sensor 40 may be omitted.

Further, in order to simplify the control process, the construction may be such that the piston 2 is brought to its ascent limit position on every cycle, and the opening and closing operations of the ascent valve 26 and descent valve 24 performed in the steps 11 and 12. The embodiments of this invention in which an exclusive property or privilege is claimed are defined as follows:

What is claimed is:

1. A tank cleaning device comprising:

a cylinder fixed to an outside of a tank, a piston housed inside said cylinder such that it is free to slide axially in said cylinder, a piston rod fixed to said piston and having an end projecting inside said tank, said piston rod elongating and contracting outside said cylinder between a limiting elongated position and a limiting contracted position according to the slide of said piston, a first pressure chamber formed by said piston around said piston rod inside said cylinder, a second pressure chamber formed by said piston on the opposite side of said piston rod inside said cylinder, a nozzle attached to the projecting end of said piston rod, pump means for providing a pressurized fluid, a first supply passage connecting said first pressure chamber to said pump means, a return passage connecting said second pressure chamber to a drain, a first valve provided in said return passage, a second supply passage connecting said second pressure chamber to said pump means, a second valve provided in said second supply passage, a passage formed inside said piston rod for the purpose of guiding said pressurized fluid from said first pressure chamber to said nozzle, means for detecting a contracted position of said piston rod, means for detecting an elongated position of said piston rod, means for closing said first valve and opening said second valve when said contracted position is detected, means for opening said first valve and closing said second valve when said elongated position is detected, means for counting the number of contraction and elongation cycles executed by said piston rod between said contracted position and said elongated position, and means for stopping operation of said pump means when it is detected that said number of contraction and elongation cycles has reached a predetermined value.

2. A tank cleaning device as defined in claim 1, wherein said contracted position is less contracted than said limiting contracted position, and said elongated position is set equal to said limiting elongated position.

3. A tank cleaning device as defined in claim 1, wherein said counting means comprises means for counting the number of times said piston rod reaches said contracted position.

4. A tank cleaning device comprising:

a cylinder fixed to an outside of a tank, a piston housed inside said cylinder such that it is free to slide axially in said cylinder, a piston rod fixed to said piston and having an end projecting inside said tank, said piston rod elongating and contracting outside said cylinder between a limiting elongated position and a limiting contracted position according to the slide of said piston, a first pressure chamber formed by said piston around said piston rod inside said cylinder, a second pressure chamber formed by said piston on the opposite side of said piston rod inside said cylinder, a nozzle attached to the projecting end of said piston rod, pump means for providing a pressurized fluid, a first supply passage connecting said first pressure chamber to said pump means, a return passage connecting said second pressure chamber to a drain, a first valve provided in said return passage, a second supply passage connecting said second pressure chamber to said pump means, a second valve provided in said second supply passage, a passage formed inside said piston rod for the purpose of guiding said pressurized fluid from said first pressure chamber to said nozzle, means for detecting a contracted position of said piston rod, said contracted position being less contracted than said limiting contracted position, means for detecting an elongated position of said piston rod, said elongated position being equal to said limiting elongated position, means for closing said first valve and opening said second valve when said contracted position is detected, means for opening said first valve and closing said second valve when said elongated position is detected, means for counting the number of contraction and elongation cycles executed by said piston rod between said contracted position and said elongated position, means for returning said piston rod to said limiting contracted position when said number of contraction and elongation cycles reaches a predetermined value, means for detecting that said piston rod has reached said limiting contracted position, and means for stopping operation of said pump means when it is detected that said piston rod has reached said limiting contracted position.

5. A tank cleaning device comprising:

a cylinder fixed to an outside of a tank, a piston housed inside said cylinder such that it is free to slide axially in said cylinder, a piston rod fixed to said piston and having an end projecting inside said tank, said piston rod elongating and contracting outside said cylinder between a limiting elongated position and a limiting contracted position according to the slide of said piston, a first pressure chamber formed by said piston around said piston rod inside said cylinder, a second pressure chamber formed by said piston on the opposite side of said piston rod inside said cylinder, a nozzle attached to the projecting end of said piston rod, pump means for providing a pressurized fluid, a first supply passage connecting said first pressure chamber to said pump means, a return passage connecting said second pressure chamber to a drain, a first valve provided in said return passage, a second supply passage connecting said second pressure chamber to said pump means, a second valve provided in said second supply passage, a passage formed inside said piston rod for the purpose of guiding said pressurized fluid from said first pressure chamber to said nozzle, means for detecting a contracted position of said piston rod, said contracted position being less contracted than said limiting contracted position, means for detecting an elongated position of said piston rod, said elongated position being equal to said limiting elongated position, means for closing said first valve and opening said second valve when said contracted position is detected, means for opening said first valve and closing said second valve when said elongated position is detected, means for counting the number of contraction and elongation cycles executed by said piston rod between said contracted position and said elongated position, means for stopping operation of said pump means when it is detected that said number of contraction and elongation cycles has reached a predetermined value, a pressure regulating valve for regulating a pressure provided by said pump means to a set pressure, means for detecting a direction of the slide of said piston, and means for modifying said set pressure according to said direction.

6. A tank cleaning device comprising:

a cylinder fixed to an outside of a tank, a piston housed inside said cylinder such that it is free to slide axially in said cylinder, a piston rod fixed to said piston and having an end projecting inside said tank, said piston rod elongating and contracting outside said cylinder between a limiting elongated position and a limiting contracted position according to the slide of said piston, a first pressure chamber formed by said piston around said piston rod inside said cylinder, a second pressure chamber formed by said piston on the opposite side of said piston rod inside said cylinder, a nozzle attached to the projecting end of said piston rod, pump means for providing a pressurized fluid, a first supply passage connecting said first pressure chamber to said pump means, a return passage connecting said second pressure chamber to a drain, a first valve provided in said return passage, a second supply passage connecting said second pressure chamber to said pump means, a second valve provided in said second supply passage, a passage formed inside said piston rod for the purpose of guiding said pressurized fluid from said first pressure chamber to said nozzle, means for detecting a contracted position of said piston rod, means for detecting an elongated position of said piston rod, means for closing said first valve and opening said second valve when said contracted position is detected, means for opening said first valve and closing said second valve when said elongated position is detected, means for counting the number of contraction and elongation cycles executed by said piston rod between said contracted position and said elongated position, means for stopping operation of said pump means when it is detected that said number of contraction and elongation cycles has reached a predetermined value, a pressure regulating valve for regulating a pressure provided by said pump means to a set pressure, and means for modifying said set pressure according to said number of contraction and elongation cycles.

7. A tank cleaning device comprising:

a cylinder fixed to an outside of a tank, a piston housed inside said cylinder such that it is free to slide axially in said cylinder, a piston rod fixed to said piston and having an end projecting inside said tank, said piston rod elongating and contracting outside said cylinder between a limiting elongated position and a limiting contracted position according to the slide of said piston, a first pressure chamber formed by said piston around said piston rod inside said cylinder, a second pressure chamber formed by said piston on the opposite side of said piston rod inside said cylinder, a nozzle attached to the projecting end of said piston rod, pump means for providing a pressurized fluid, a first supply passage connecting said first pressure chamber to said pump means, a return passage connecting said second pressure chamber to a drain, a first valve provided in said return passage, a second supply passage connecting said second pressure chamber to said pump means, a second valve provided in said second supply passage, a passage formed inside said piston rod for the purpose of guiding said pressurized fluid from said first pressure chamber to said nozzle, means for detecting a contracted position of said piston rod, means for detecting an elongated position of said piston rod, means for closing said first valve and opening said second valve when said contracted position is detected, means for opening said first valve and closing said second valve when said elongated position is detected, means for counting the number of contraction and elongation cycles executed by said piston rod between said contracted position and said elongated position, means for stopping operation of said pump means when said number of contraction and elongation cycles has reached a predetermined value, means for returning said piston rod to said limiting contracted position when said number of contraction and elongation cycles reaches a predetermined value, means for detecting that said piston rod has reached said limiting contracted position, a housing formed on the outside of said tank with an opening thereto for accommodating said nozzle in said limiting contracted position, a partition valve for sealing off said housing from said tank, and means for closing said partition valve when said piston rod has reached said limiting contracted position.

* * * * *